US009549599B2

(12) United States Patent
Bedman et al.

(10) Patent No.: US 9,549,599 B2
(45) Date of Patent: Jan. 24, 2017

(54) STACKABLE GEMSTONE CARRYING CASE

(71) Applicants: Margo O'Tyson Bedman, Houston, TX (US); Peter George Carlier, Marysville, WA (US); Lisa Brooks Pike, Marysville, WA (US)

(72) Inventors: Margo O'Tyson Bedman, Houston, TX (US); Peter George Carlier, Marysville, WA (US); Lisa Brooks Pike, Marysville, WA (US)

( * ) Notice: Subject to any disclaimer, the term of this patent is extended or adjusted under 35 U.S.C. 154(b) by 0 days.

(21) Appl. No.: 14/578,995

(22) Filed: Dec. 22, 2014

(65) Prior Publication Data

US 2016/0174675 A1 Jun. 23, 2016

(51) Int. Cl.

| | |
|---|---|
| ***A45C 11/16*** | (2006.01) |
| ***A47F 3/00*** | (2006.01) |
| *A47F 7/02* | (2006.01) |
| *B65D 21/02* | (2006.01) |

(52) U.S. Cl.

CPC ..... *A45C 11/16* (2013.01); *A47F 3/005* (2013.01); *A47F 7/02* (2013.01); *B65D 21/0219* (2013.01)

(58) Field of Classification Search

CPC ..... A45C 11/16; A45C 2200/10; A47F 3/005; A47F 3/007; A47F 3/14; A47F 3/145; A47F 5/0043; A47F 7/02; A47B 87/0276; B65D 21/0223; B65D 21/0222; B65D 21/022; B65D 21/019; B65D 21/0219; B65D 21/0217

USPC ..... 206/6.1, 732, 566, 508, 557, 8, 520, 565,206/460; 220/377

See application file for complete search history.

(56) References Cited

U.S. PATENT DOCUMENTS

| | | | | |
|---|---|---|---|---|
| 5,908,114 | A | 6/1999 | Althouse et al. | |
| 7,458,472 | B2 * | 12/2008 | Chung | B32B 7/12 211/49.1 |
| 7,780,005 | B2 | 8/2010 | Allison et al. | |
| 2003/0209847 | A1 | 11/2003 | Allison et al. | |
| 2003/0211255 | A1 | 11/2003 | Allison et al. | |

(Continued)

OTHER PUBLICATIONS

Excerpts from the Neuheuser Katalog 2013, 14 pages.

(Continued)

*Primary Examiner* — Anthony Stashick
*Assistant Examiner* — Robert Poon
(74) *Attorney, Agent, or Firm* — Shaukat A. Karjeker; Carstens & Cahoon, LLP

(57) ABSTRACT

An exemplary embodiment provides a stackable container for gemstones that has an optically clear lid having an optically planar upper surface with a first optical property, such as a refractive index. The lid has an underside coating of a clear gel adhesive having a second optical property matched with the first optical property to minimize optical distortion. The gel releasably adheres gemstones to the lid. The base and lid of the stackable container clamp releasably together without hinges and without a snap fit closure. The container has a gemstone containment volume wherein gemstones appear to "float" and can be examined. For stackability, an upper region of the lid mounts releasably to an underside of a base of a like second stackable container; and the base mounts releasably to an upper region of a lid of a like third stackable container such that a plurality of stackable containers are stackable in an array.

14 Claims, 9 Drawing Sheets

(56) References Cited

U.S. PATENT DOCUMENTS

| | | | | |
|---|---|---|---|---|
| 2005/0098469 | A1* | 5/2005 | Agakanian | B65D 21/0204 206/503 |
| 2005/0183983 | A1* | 8/2005 | Ovadia | A45C 11/16 206/566 |
| 2007/0080077 | A1* | 4/2007 | Thormahlen | A45C 11/24 206/6.1 |
| 2010/0065461 | A1* | 3/2010 | Chhay | B65D 21/0222 206/505 |

OTHER PUBLICATIONS

Excerpts from the Stuller Catalog 2013, 15 pages.
Delphon Gel-Coated Shipping Carriers, printed Aug. 6, 2014, from http://www.delphon.com/products-services/gel-pak-shipping-carriers/ 4 pages.
Gel-Pak Press Release dated May 16, 2012, 2 pages.
Delphon Gel-Pak Jewelry Boxes printed Aug. 6, 2014, from http://www.delphon.com/gelpak/ 3 pages.
Gel-Pak Technical Datasheet List printed Aug. 6, 2014, from http://admingelpak.com/literatures/index.cfm?fuseaction=datasheets 2 pages.
Gel-Pak Technical Datasheet for DGL Gel-Film, 1 page.
Gel-Pak Technical Datasheet for PF Gel-Film, 1 page.
Gel-Pak Technical Datasheet for WF Gel-Film, 1 page.
Quik-Pak information sheet printed Aug. 6, 2014, from http://www.icproto.com/ 2 pages.
Casey Krawiec, Quik-Pak Technical Article entitled "The Need for the Open Molded Plastic Package", Feb. 2012, 3 pages.
Delphon bio p., printed Aug. 6, 2014, from http://www.sverica.com/portf_delphon.html 1 page.
Delphon welcome page, printed Aug. 6, 2014, from http://www.delphon.com/ 2 pages.
Gel-Pak info page, located at www.delphon.com/gelpak 1 page.
Dow Corning Material Safety Data Sheet, Version 2.3, Revision Date Jun. 4, 2013, 8 pages.
Dow Corning Product Information sheet for Sylgard 184 silicone Elastomer, Jul. 11, 2013, 3 pages.
Mark Fox "Optical Properties of Solids", Oxford University Press, 2001, 58 pages (downloaded in three separate documents due to size limitations).
Various photographs of gem boxes including views of the boxes full of gems and on display, empty boxes, packaging showing, gems in boxes, in trays, in cases, etc., 11 pages.
Excerpts from the Rio Grande Catalog, 2013, pp. 1005-1012, 8 pages.

* cited by examiner

STACKABLE GEMSTONE CARRYING CASE

BACKGROUND

1. Field of the Technology

The technology relates to stackable containers for the transport and display of gemstones, and more particularly to stackable containers having optically clear lids for ease of examining the gemstones and that are configured and sized for stackable storage of the stackable containers.

2. Description of the Related Art

Gemstones that have been cut and faceted are typically sorted before being transported to locations through the marketing chain from cutting facility to the final point of sale. Gemstones are usually sorted and grouped into similar grades and sizes. The gemstones are also stored at various locations during flow through the marketing chain.

During transport, many gemstones may be contained in a single container such as a pouch, or a box. Box containers often include a soft material, such as cotton or other textile that provide a cushion on which the gemstones rest. The cushioning is often ineffective in maintaining gemstones in position during handling of the box containers, for example during transport of the containers. Movement of the gemstones during handling is undesirable because it increases the risk of damage to the stones from stones impacting against each other causing chipping of the stones, reducing the value of the stones or even rendering them worthless Alternatives, such as adhesively securing the gemstones in position have been attempted.

At each stage, when the gemstones are to be examined, typically by a jeweler or gemologist, the container is opened and gemstones must be individually selected and examined. The sorting of gemstones, particularly natural gemstones having color and shade ranges, is a time consuming and expensive process, taking into account the specialized labor costs of a skilled gemologist. Moreover, once examined and replaced in a box container, the gemstones are able move within the box container during handling, and the gemstones are again "mixed up" within the container necessitating re-examination and re-sorting at the next party in the supply chain.

SUMMARY

An exemplary embodiment provides a stackable re-usable container for gemstones that has an optically clear lid having an optically planar upper surface with a first optical property. The lid has an underside coating of a clear gel composition having a second optical property and having a degree of adhesiveness sufficient to releasably hold gemstones in contact with the gel in fixed position during ordinary forces encountered during transportation of the container. The first and second optical properties are selected to minimize optical distortion when examining a gemstone, which is adhered to the gel composition, through an upper surface of the lid. The stackable container further has a base sized to register with the lid and configured to clamp releasably to the lid with a frictional clamping force, without hinges and without a snap fit closure. The frictional clamping force between the lid and the base is sufficient to maintain the stackable container closed and when the stackable container is opened in normal use, the frictional clamping force is overcome without generating forces that cause dislodging of a contained gemstone from the gel coating. The base is sized to provide a gemstone containment volume between the underside of the lid and the base, that has a depth such that when a gemstone is contained within the containment volume, the gemstone does not touch the upper surface of the base, and is viewable in 360 degrees. The gemstone appears to "float" within the containment space. For stackability, an upper region of the lid is adapted to friction-mount releasably to an underside of a base of a like second stackable container; and a lower region of the base is adapted to friction-mount releasably to an upper region of a lid of a like third stackable container such that a plurality of stackable containers are stackable in an array.

Optionally, an exemplary stackable container may have a top side of the base including an upward projecting wall spaced from the sides of the base and extending around a perimeter of the base. This wall is sized and configured to register the base with the lid and to clamp the base to the lid with frictional force.

Also optionally, an exemplary stackable container may include a pry slot formed on a side of the base. The exemplary pry slot may extend in depth from the side of the base up to the upwardly projecting wall such that, when the container is closed, a portion of the edge of the lid is exposed to thereby facilitate manual separation of the lid from the base.

Yet further optionally, an exemplary stackable container may have an upper region of the lid is stepped inward and sized to register with and friction-mount releasably to an underside of a base of a like second container. The underside of the base may have a wall extending at least partially around the perimeter of the base to surround a recessed region within the base. The recessed region is sized to receive the upper stepped and optically clear region of a lid of a like third stackable container such that a plurality of stackable containers is stackable in a vertical array.

Optionally, in an exemplary embodiment, the lid of the stackable container may include a slot in an upper surface that is spaced from a side of the lid and sized to register with and receive therein in a friction-mount a projecting tab from an underside of a base of a like second stackable container. The underside of the base may have a projecting tab, spaced from a perimeter of the base, that is sized for friction fit to the slot in a lid of a like third stackable container such that a plurality of stackable containers are stackable in a vertical array.

Further optionally, an exemplary embodiment of the stackable container is sized and configured such that a side-by-side array of containers fits snugly within a jeweler's tray of standard dimensions.

The following is a summary of some aspects and exemplary embodiments of the present technology, of which a more detailed explanation is provided under the Detailed Description section, here below.

BRIEF DESCRIPTION OF THE DRAWINGS

The foregoing aspects and many of the attendant advantages of the present technology will become more readily appreciated by reference to the following Detailed Description, when taken in conjunction with the accompanying simplified drawings of exemplary embodiments. The illustrative, schematic drawings, briefly described here below, are not to scale, are presented for ease of explanation and do not limit the scope of the inventions recited in the accompanying patent claims.

DETAILED DESCRIPTION

Figure 1:
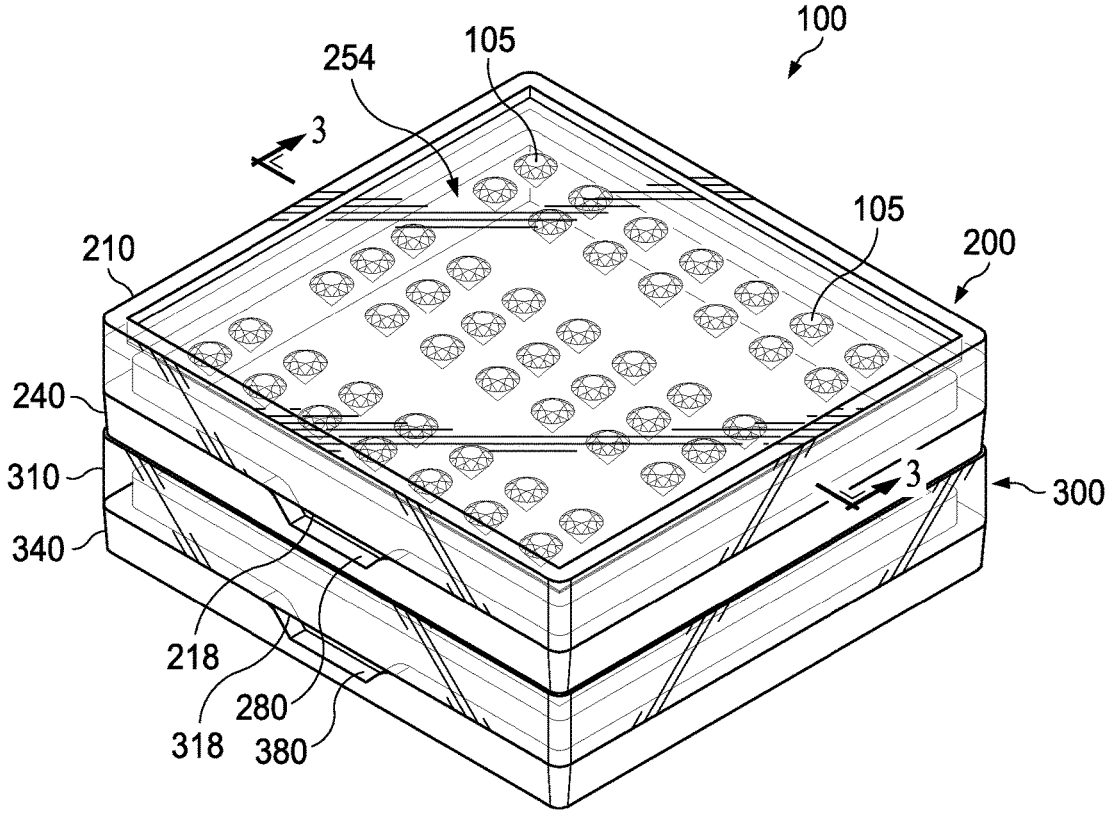
FIG. 1 illustrates two stacked exemplary embodiments of a stackable gemstone case.

The following non-limiting detailed descriptions of examples of embodiments of the technology may refer to appended drawing Figures and are not limited to the drawings, which are merely presented for enhancing explanations of features of the technology. In addition, the detailed descriptions may refer to particular terms of art, some of which are defined herein, as appropriate and necessary for clarity.

During the handling, transportation and storage of cut gemstones in a supply chain, the gemstones are subjected to a wide range of conditions, such as forces and temperatures, that might have an adverse physical effect. For example, in the prior art gemstones that are transported in a parcel of stones may collide with each other and cause chipping of the stones. In addition, gemstones may be handled many times, and may be dropped onto a hard surface and be damaged.

It is desirable to keep the stones separated from each other during transportation, handling and storage to avoid or minimize the risk of physical damage to the gemstones. Further, it is desirable to avoid or minimize handling of the gemstones to examine the stones, for example, for gemstone size and quality. Quality might be quantified based on whether the gemstone is "flawless" or the extent of flaws, the cut of the stones, and their clarity, for example. In the prior art these factors would generally require a gemologist to remove the gemstones from their container to examine each of them visually, often using a loupe. In the prior art, once examined, the gemstones may be replaced in the container, and are then subject to being mixed with other gemstones in the container so that a next party in the supply chain would have to repeat the examination and hand sorting process. This is time consuming and expensive, and has an inherent risk of damage to the gemstones.

It is desirable for a gemologist to be able examine each gemstone without removing the individual stones from their container. Moreover, it is desirable for the gemstone container to be re-usable for onward shipment of the gemstones to a next party in the supply chain. Being able to maintain the gemstones in the same container, and being able to examine the gemstones while they are in the container, minimizes costly labor and reduces the risk of gemstone loss and/or damage.

During handling of prior art mass-produced containers that have plastic hinged lid-to-base construction, and snap fit closures to a plastic base, the snap fit closures require varying amounts of force to open, and the containers may spring open spilling gemstones from the container. This not only necessitates laborious repackaging, but could result in loss of gemstones or damage to gemstones. In addition, the plastic is not of optical quality, and does not therefore present a distortion-free view of the contained gemstones.

In an exemplary embodiment, there is provided a re-usable gemstone container, such as a carrying case, wherein gemstones can be stored releasably, but are maintained in fixed position in the gel and in relation to each other, when subjected to forces encountered during ordinary handling transportation and storage. Moreover, the gemstone container includes an optically clear plastic lid of a planar optical quality that avoids or minimizes distortion of gemstones as seen through the lid, so that the gemstones can be evaluated by a gemologist without need to remove them from the container. In an exemplary embodiment the optical quality clear upper lid portion is so distortion-free that a gemologist can examine and evaluate the gemstones either with the naked eye, or with a loupe. This avoids the need to remove the gemstones from the container and minimizes risk of damage or loss, while retaining the integrity of the ordered arrangement of the gemstones within the container, where they are releasably adhered to the optically clear lid such that they present an appearance of "floating" in the container.

Figure 2:
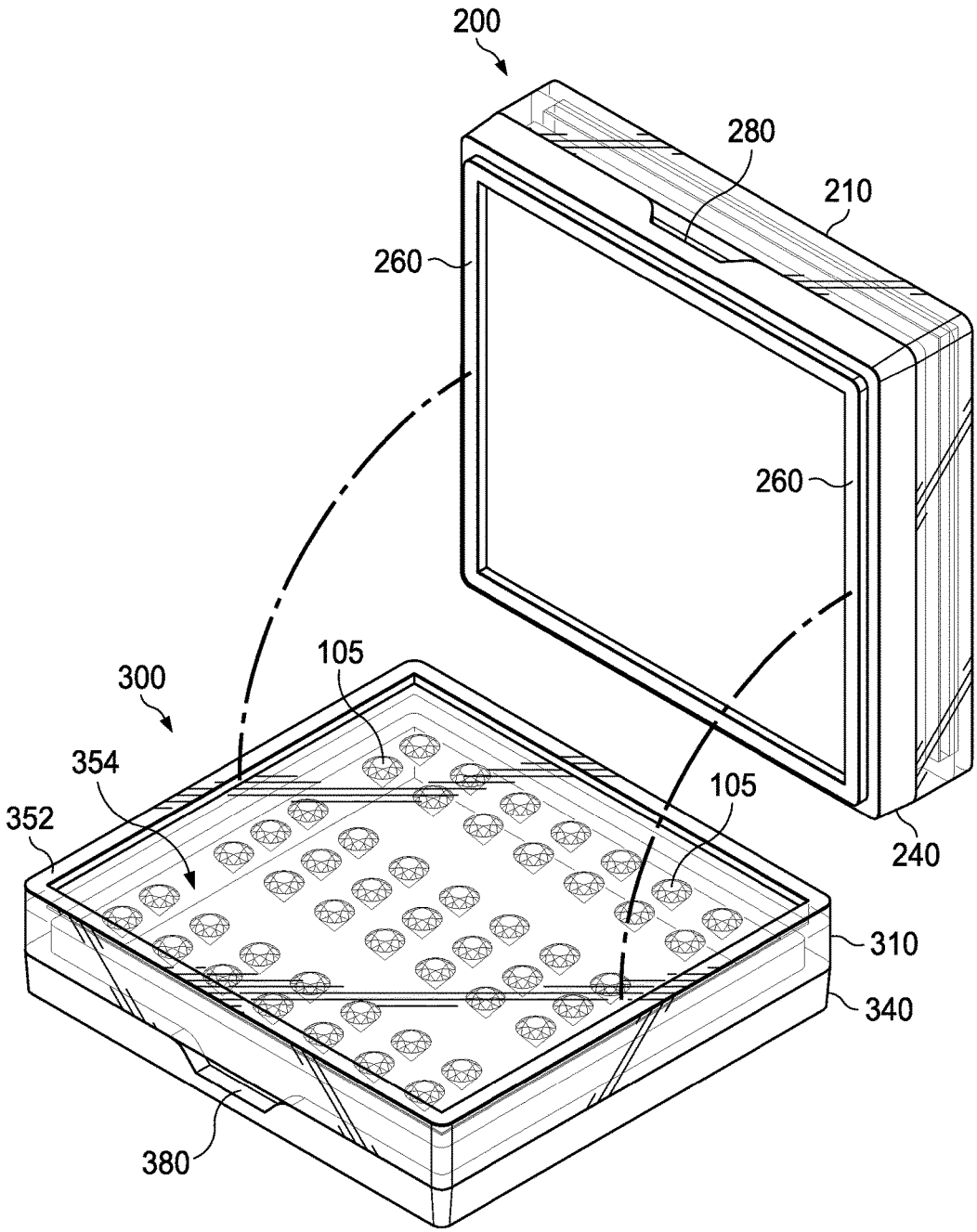
FIG. 2 illustrates the two exemplary embodiments of FIG. 1, as separated from each other.
Figure 3:
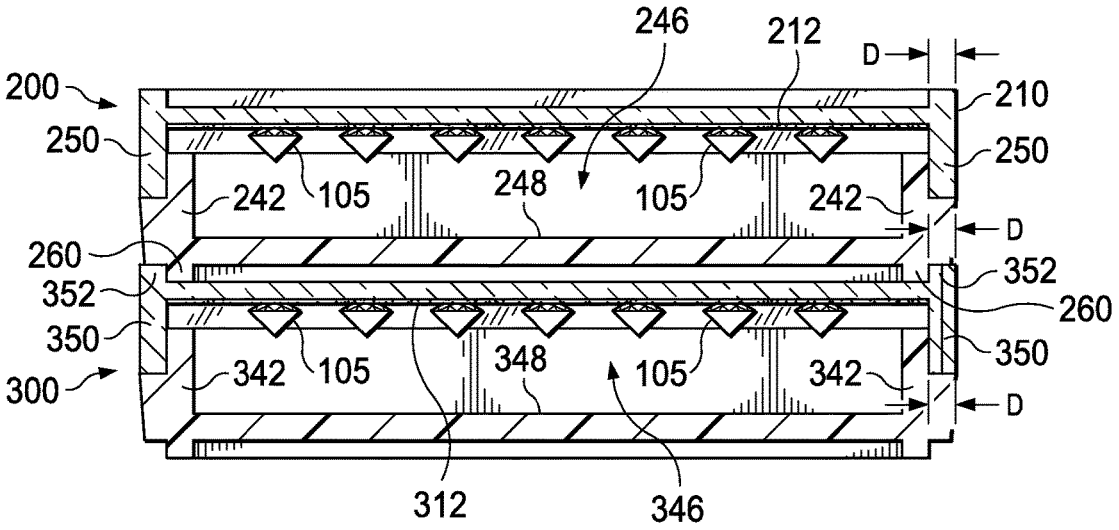
FIG. 3 illustrates a cross sectional view along 3-3 of FIG. 1.
Figure 4:
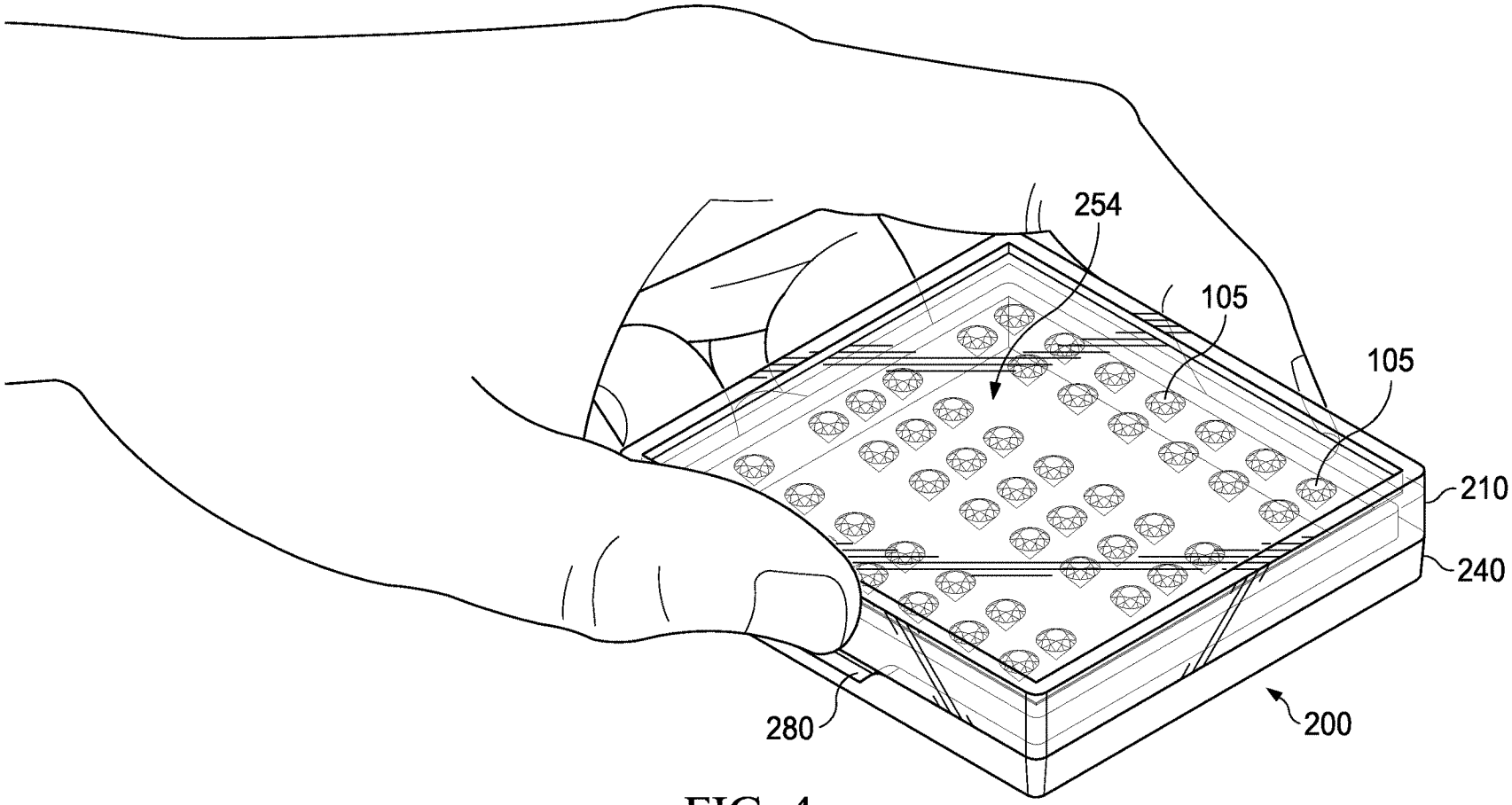
FIG. 4 is a schematic illustration depicting a hand gripping an exemplary embodiment of a stackable gemstone case.

An exemplary embodiment illustrated in FIGS. 1-3, shows a stacked array 100 of two identical stackable containers 200, 300 albeit that more containers can also be stacked, one atop the other, as shown. The containers are numbered differently (200 series for the upper, and 300 series for the lower container, for ease of explanation). Each container 200, 300 contains gemstones adhered to an underside of a lid 210, 310. As seen more clearly in FIG. 3, the lids 210, 310 each have an adhesive gel coating 212, 312 on a lid underside, and the gemstones 105 are adhered releasably to this gel coating. In an exemplary embodiment, the gel coating has an optical property, that is matched to the same optical property of the optically clear plastic lid such as to maximize the reflection of light (enhance sparkle) and minimize optical distortion when a gemologist views the gemstones through the lid. The optical property may be a refractive index, coefficient of reflection (reflectivity), capability to scatter light, optical density, and the like, as set forth in "Optical Properties of Solids," by Mark Fox, Department of Physics and Astronomy University of Sheffield, published by Oxford University Press, New York, (first published in 2001, which is hereby fully incorporated by reference. In a preferred embodiment, the plastic lid has the composition of optically clear plastic, similar to a grade which is used in eyeglasses. Also, the clear adhesive gel is heat and cold resistant under ordinary conditions of use of the gemstone containers. In an exemplary embodiment, the gel maintains its adhesive properties in a broad range of temperatures, namely, from approximately −20 degrees Fahrenheit to approximately +180 degrees Fahrenheit. An exemplary and acceptable gel is sold under the name SYLGARD 184 Silicone Elastomer, available from Dow Corning. This exemplary gel can be used in conjunction with a crystal polystyrene lid, of optical quality, preferably un-tinted to permit a clear and undistorted view of gemstones through the lid as these gemstones are held in the gel. The material of the base may be general purpose polystyrene, and the base material need not be optically clear. The foregoing examples do not limit the specific materials of the base, the lid, or the gel. Selection of alternative gel and lid combinations are encompassed by the present technology, as long as these perform the functions of retaining gemstones in place in the gel layer on the lid and permit a distortion-free view of the gemstones through the lid, which would be optically clear, and un-tinted, such that a gemologist can evaluate the gemstones without need to remove them from the container.

In the exemplary embodiment, a top side of the bases 240, 340 each comprises an upward projecting wall 242, 342 spaced from the sides 244, 344 of the base and extending around a perimeter of the base to enclose a containment space 246, 346. The upward projecting walls 242, 342 are sized and configured to each register with their respective lids 210, 310 and to clamp to the peripheral walls 250, 350 of the lids 210, 310 with frictional force to inside surfaces of walls 242, 342, respectively. The frictional force is such that separation of a lid from a base does not cause the gemstones to be dislodged from the gel adhesive layer. In an exemplary embodiment, the peripheral walls and/or the projecting walls may be slightly tapered to further facilitate a friction fit that requires a force of such magnitude as to permit opening the container by separating the lid from the base, without causing the gemstones to be dislodged from the gel adhesive layer. For example, to provide audible feedback of container closure, the lid may "click" shut on the container, without the use of any snap-fit type closure mechanism, including one that would prevent the stacking of multiple containers. Thus, the "click" would provide audible indication that the lid is fully engaged with the base. Further, for example, the lid may "click" shut, and the positive closure may provide tactile feedback as well as audible feedback.

As illustrated, the containment space 246, 346 has a depth such that when a gemstone 105 is contained within the containment volume, the lower end of the gemstone does not touch the upper surface 248, 348 of the bases 240, 340. As a result, a gemstone 105 is viewable in 360 degrees, or nearly so, such as to provide an appearance of the gemstone "floating" within the container 200, 300, when viewed through the optically clear and substantially optic distortion-free lid upper area 254, 354, when viewed through the lid upper surface. Clear or colorless gemstones, such as diamonds, are typically displayed and transported in gemstone containers 200, 300 wherein the upper surfaces 248, 348 of the bases 240, 340 are black in color. When displaying and transporting colored gemstones in the containers 200, 300, the upper surfaces 248, 348 of the bases 240, 340 are more typically white in color.

The containers 200, 300 are stackable to form an array, one atop the other, held in place by frictional forces between adjacent containers. The array of containers is stable and can withstand moderate separation forces as may be encountered in normal use, without tumbling apart. However, the individual containers can be separated by application of force that is not so great as to cause dislodgment of gemstones from the gel adhesive coating.

FIG. 2 illustrates the separation of an exemplary embodiment that includes two stackable containers 200, 300. In the illustrated example, the upper container 200 has a base 240 that includes (underneath the base) a planar recess surrounded by a base wall 260 that is spaced inboard, away from the outer perimeter of the base, by a distance D. The lid 310 of the depicted lower container 300 includes a perimeter wall 352 of thickness approximating D, and surrounding a central planar optically clear region 354 of the lid 310. Accordingly, the base 240 registers with the lid 310 such that the base wall 260 fits snugly against inboard surfaces of the perimeter wall 352 of the lid. This provides a friction fit. Of course, the base wall and the perimeter wall may have tapered surfaces that provide an enhanced friction fit. Clearly, a plurality of containers may be stacked in a vertical array, and the stack is not limited to two containers.

Figure 5:
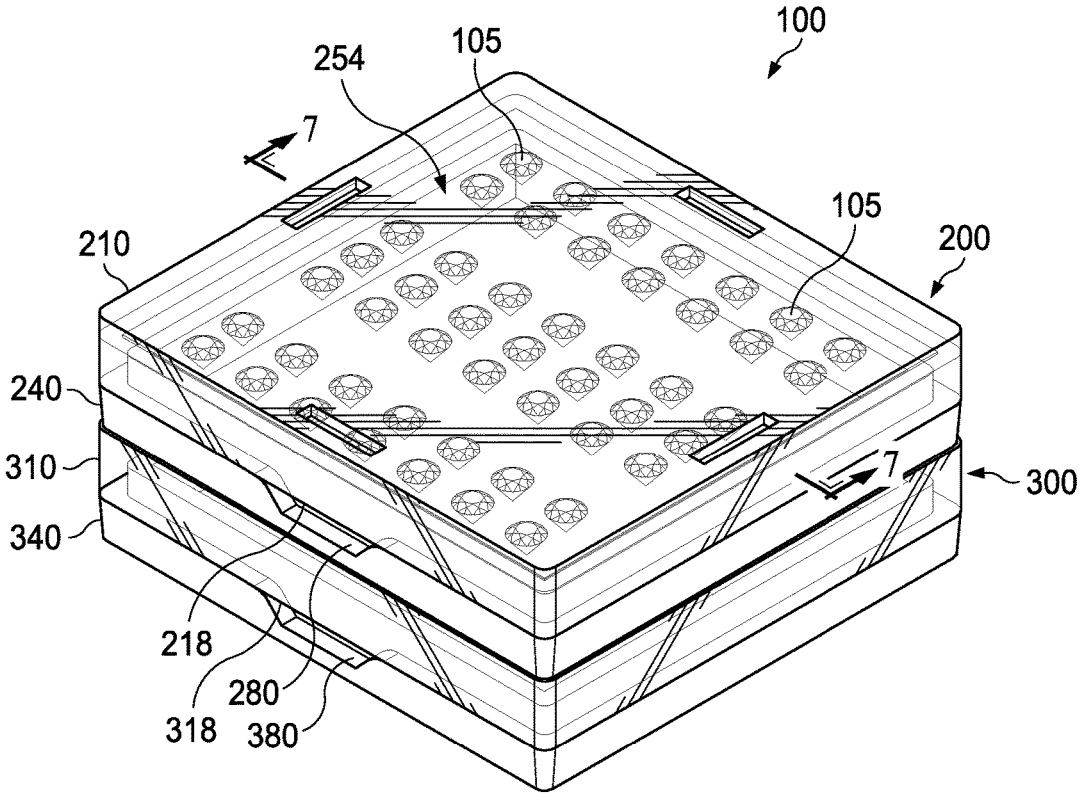
FIG. 5 illustrates another exemplary embodiment of two exemplary stackable gemstone cases.
Figure 6:
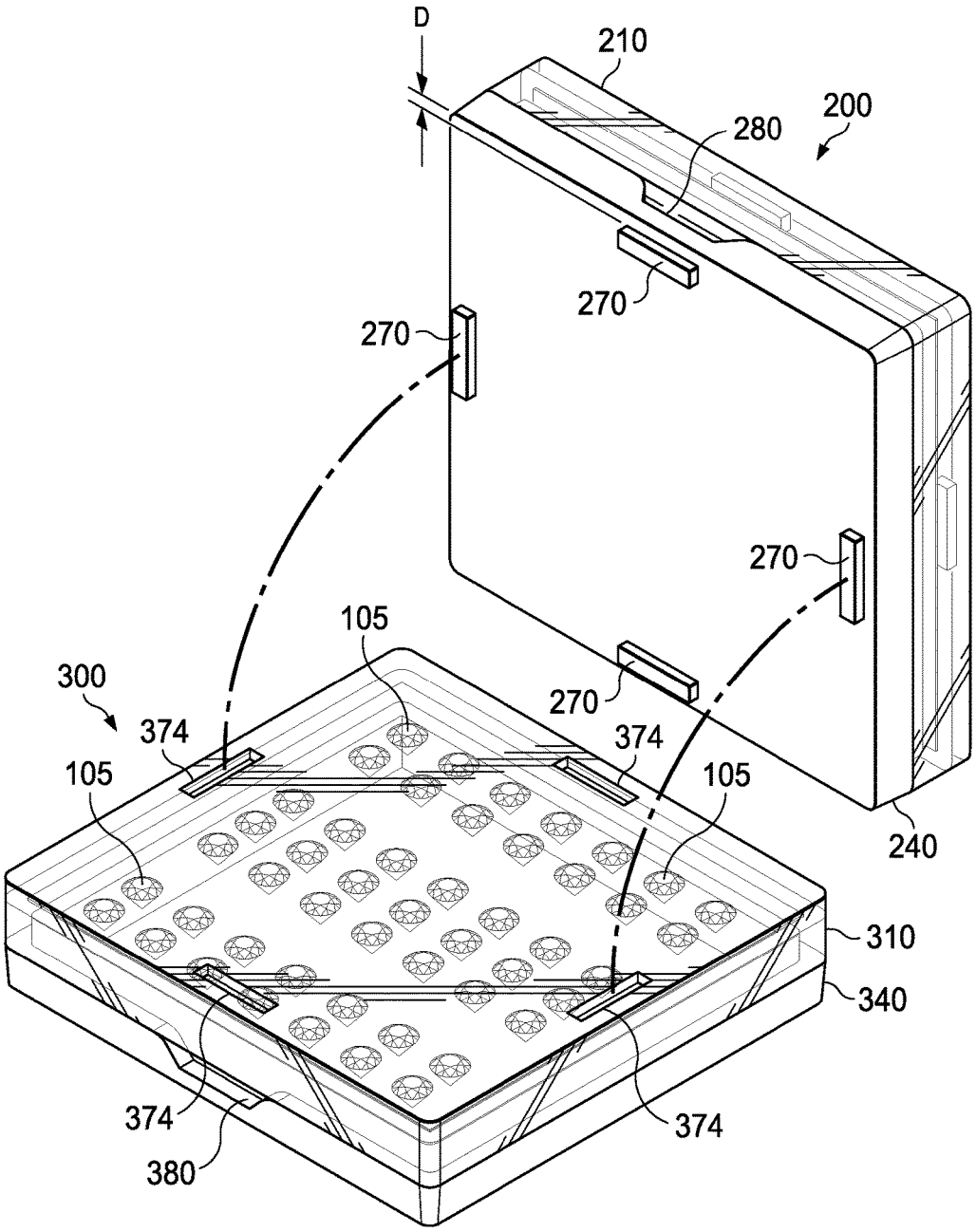
FIG. 6 illustrates the two exemplary embodiments of stackable gemstone cases of FIG. 5, as separated from each other.
Figure 7:
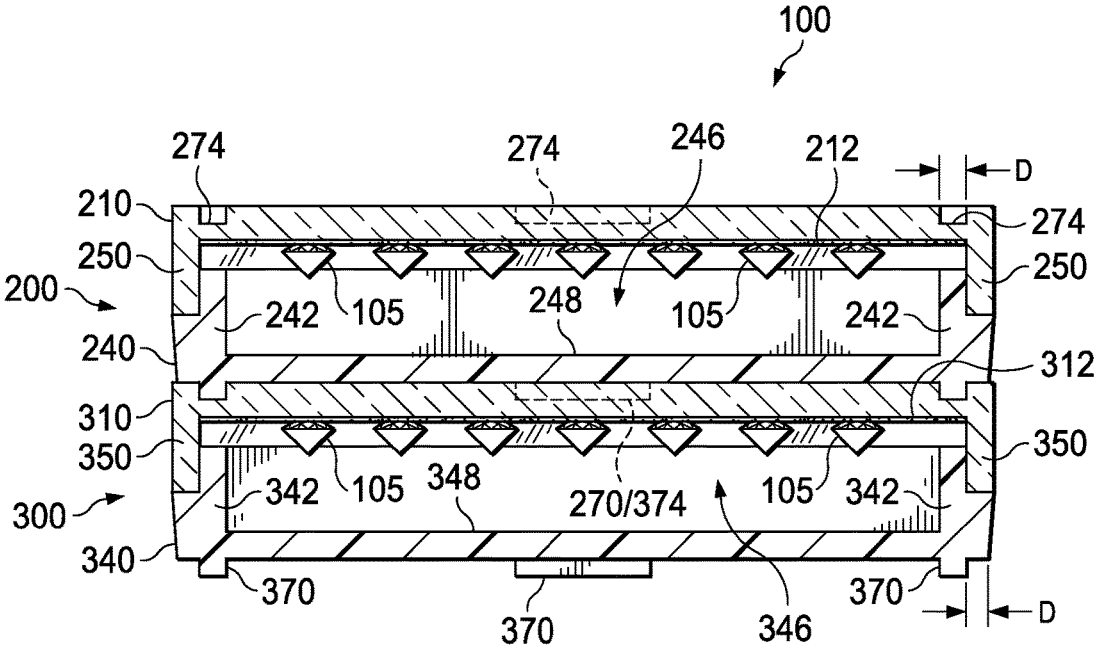
FIG. 7 illustrates a cross sectional view along 7-7 of FIG. 5.

FIG. 5 depicts another exemplary embodiment 100 that includes two identical stackable containers 200, 300. FIG. 6 illustrates the separation of these exemplary embodiments 200, 300. In this example, the upper container 200 has a base 240 that includes a rectangular array of location projectors 270 each aligned with a side of the base, and spaced away from the side by a distance D. The lid 310 of the lower container 300 includes a rectangular array of locator slots 374 spaced to register with the location projectors 270 of the base 240. Accordingly, the base 240 registers with the lid 310 such that the location projectors 374 each fits snugly into and is engaged frictionally by a corresponding locator slot 270. This provides a friction fit. Of course, the locator slots and location projectors may have tapered surfaces that form an interference fit, as well as providing a friction fit. Clearly, a plurality of containers may be stacked in a vertical array, and the stack is not limited to two containers.

As seen more clearly in FIGS. 1, 2, 4, 5 and 6, exemplary embodiments may include a pry slot 280, 380 that facilitates separating the lid 210, 310 of a the container from the base 240, 340. The slot 280, 380 is formed on a side of the base and extends in depth from the outside of the base up to the upwardly projecting wall 242, 342 where it terminates with a gap between it and the lower edge of the lid 218, 318. As a result, when the container is closed, the pry slot permits access, through the gap, to under the edge of the lid so that the lid can be more easily pried from the base by application of controlled force (preferably with a tool) to urge the lid edge away from the base.

Figure 8:
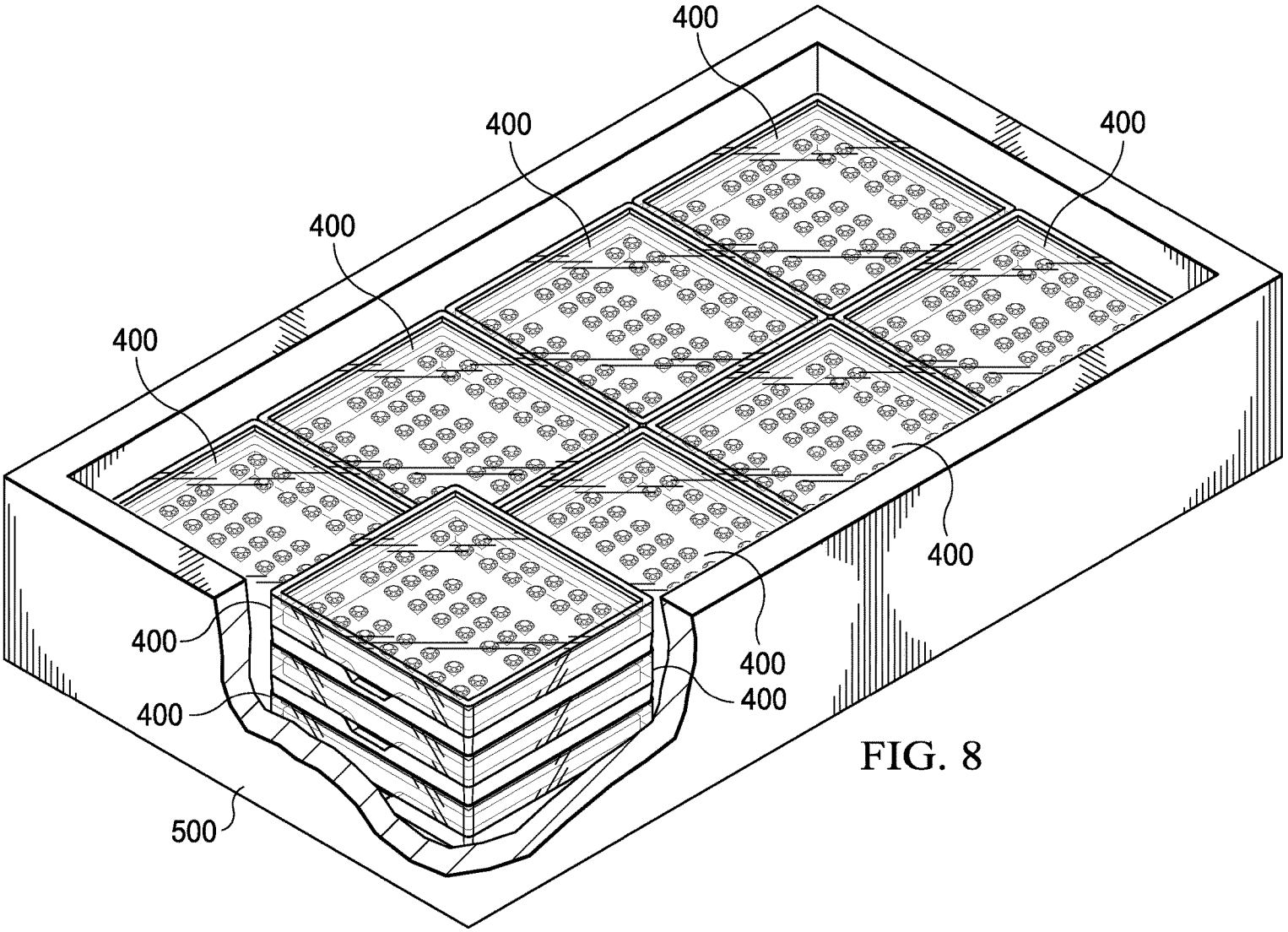
FIG. 8 illustrates an array of exemplary embodiment of two stackable gemstone cases snugly fit within a jeweler's tray.

Generally, jewelers utilize standard sized trays on which to display gemstones, for convenience. An exemplary embodiment of the stackable containers 400 may have length and width dimensions permitting arrayed storage in a tray 500 as shown in FIG. 8, for example. Further, the exemplary stackable containers may have a height that permits 3-deep storage of the stackable containers on the tray. Of course, other stackable container dimensions may also be useful, and several different sizes are shown in FIG. 9.

Figure 9:
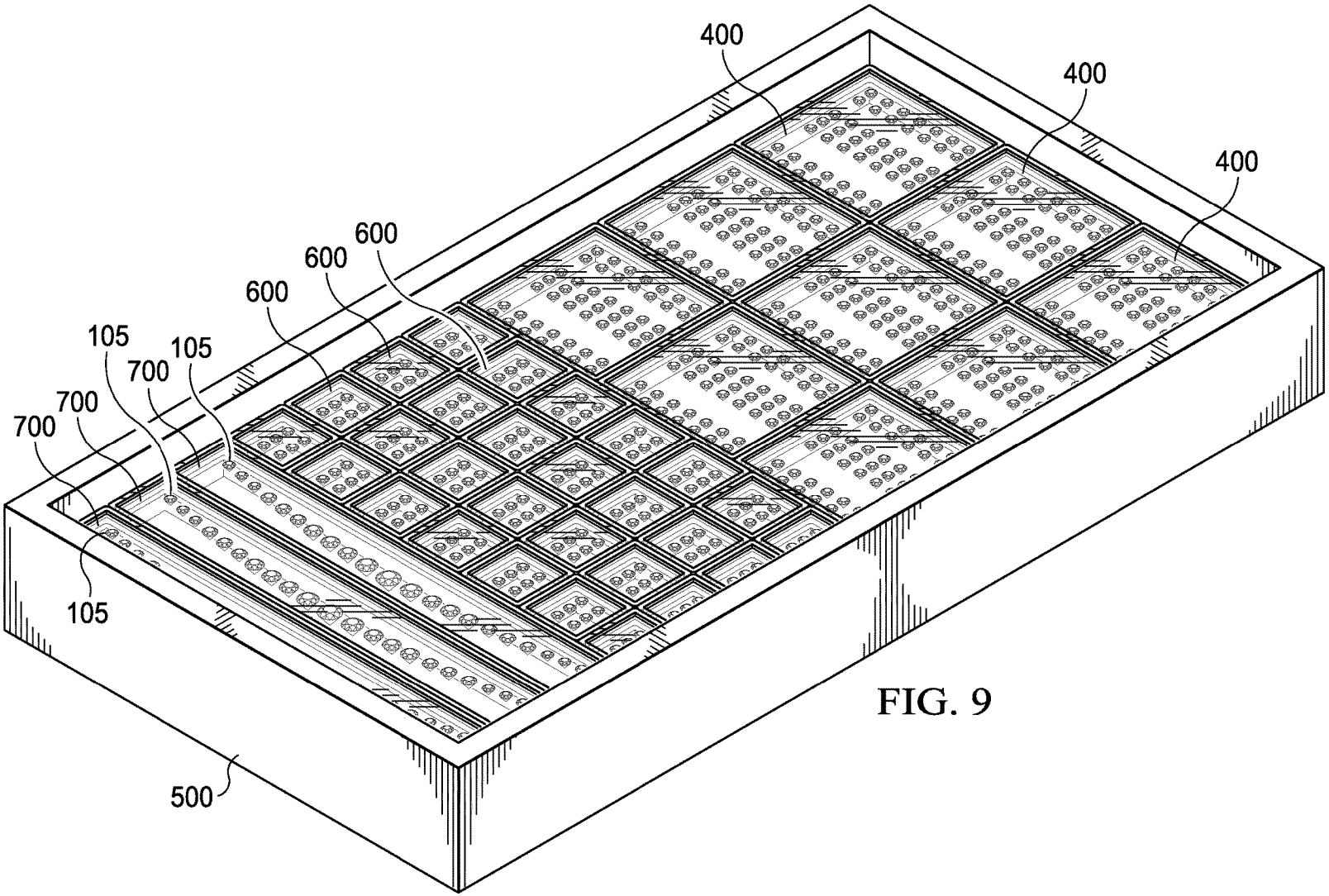
FIG. 9 illustrates exemplary embodiments of gemstone cases of different sizes, all designed to fit together within a jeweler's tray.

In FIG. 9, there are illustrated 3 different sizes and shapes of gemstone containers 400, 600, and 700 packed snugly within a jeweler's tray 500. As indicated, the rectangular gemstone containers 700 may have the gemstones 105 arranged in a pre-sorted fashion for manufacture of a necklace, for example. Thus, the largest gemstone (or one that is to be the center of the necklace) is positioned in the center of the container with gemstones of other sizes (and optionally other colors, as desired) arranged on either side. This use of the gemstone containers to display gemstones in the same order as they would be arranged in a piece of jewelry has several advantages. Firstly, the gemstones need only be sorted once by a gemologist (time consuming and expensive work) and are then placed in proper sequential order in the container for the particular design and the order is maintained by the gel adhesive. This saves time (and money) in that the buyer of the container of gemstones avoids re-sorting costs, and has the gemstones already presented in the container an ordered array for inclusion into a jewelry setting. Further, the arrangement of the gemstones in the container permits ready visualization by another party (potential buyer, for example) of the jewelry article as it may appear in a variety of settings. In addition, a buyer having a particular setting for a jewelry piece may be able to place an order for the number and size gemstones that would fit into each jewelry piece and these gemstones could be supplied in a gemstone container that has the number of gemstones pre-arranged in the order in which they are to be fitted to the setting for the jewelry piece. This is particularly useful where many copies of the jewelry article will be made: sorting costs are reduced, and lower cost labor may be used.

In exemplary embodiments, the containers are fabricated of "plastics," which are more strictly referred to as "organic polymers," or composites of these organic polymers. As explained above, the upper portions of the lid must be optically clear and optically undistorted to allow an advantage of the stackable containers, namely, the ability to view and examine gemstones adhered to the coating of the lid underside. Otherwise, materials are not critical for other features of the containers. For example, the base could be of wood or metal, preferably of light weight to facilitate ease of carrying and handling. Likewise, sides of the lid might be of lightweight opaque materials. In an exemplary embodiment, the base is injection molded plastic, as is the lid. The lid may subsequently be "finished" to ensure that it is substantially free of optical distortion such that gemstones can be viewed for evaluation by a gemologist through the lid, without need to remove the gemstones from the container.

While examples of embodiments of the technology have been presented and described in text and some examples also by way of illustration, it will be appreciated that various changes and modifications may be made in the described technology without departing from the scope of the inventions, which are set forth in, and only limited by, the scope of the appended patent claims, as properly interpreted and construed.

The invention claimed is:

1. A stackable container sized and configured for containing a plurality of individual gemstones comprising:

an optically clear lid of a planar optical quality having an upper surface with a first optical property, the lid having an underside coating of a clear adhesive gel composition having a second optical property, the underside coating releasably holding the plurality of individual gemstones in fixed position on an underside of the lid during transportation of the container; and a base sized to register with the lid, and configured to clamp releasably to the lid with a frictional clamping force, without hinges and without a snap fit closure, the base further sized to provide a gemstone containment volume for the plurality of individual gemstones between the underside of the lid and the base, the containment volume having a depth such that when the plurality of individual gemstones is contained within the containment volume, the plurality of individual gemstones does not touch an upper surface of the base, and the plurality of individual gemstones is viewable in 360 degrees;

wherein the first and second optical properties are selected to allow the plurality of individual gemstones contained therein to each be evaluated by a naked eye, or with a loupe, through the lid of the container without need to remove each individual gemstones from the container for evaluation;

wherein the frictional clamping force maintains the stackable container closed, and when the stackable container is opened in normal use, the frictional clamping force is overcome without dislodging of a contained gemstone of the plurality of individual gemstones from the underside coating; and wherein an upper region of the lid is adapted to friction-mount releasably to an underside of a base of a second stackable container; and a lower region of the base is adapted to friction mount releasably to an upper region of a lid of a third stackable container such that a plurality of stackable containers are stackable in an array.

2. The stackable container of claim 1, wherein a top side of the base comprises an upward projecting wall spaced from the sides of the base and extending around a perimeter of the base, the wall sized and configured to register the base with the lid and to clamp the base to the lid with frictional force.

3. The stackable container of claim 2, wherein a pry slot is formed on a side of the base, the pry slot extending in depth from the side of the base up to the upwardly projecting wall such that, when the container is closed, the pry slot facilitates gripping the lid for separation of the lid from the base.

4. The stackable container of claim 1, wherein the upper region of the lid is stepped inward and sized to register with and friction-mount releasably to an underside of a base of a second container; and wherein the underside of the base has a surrounding wall around the perimeter of the base, the surrounding wall enclosing a recessed space within the base sized to receive the upper stepped region of a lid of a third container such that the container is stackable in an array with the second and third containers.

5. The stackable container of claim 1, wherein the lid comprises a slot in an upper surface thereof, the slot spaced from a side of the lid; and sized to register with and receive therein a projecting tab from an underside of a base of a like second container in a friction-mount; and wherein the underside of the base has a projecting tab spaced from a perimeter of the base, the projecting tab sized for friction fit to a slot in a lid of a like third container such that the container is stackable in an array with the second and third containers.

6. The stackable container of claim 1, wherein the container is sized and configured such that a side-by-side array of containers fits snugly within dimensions of a jeweler's tray.

7. A stacked array of stackable containers, each sized and configured to contain a plurality of individual gemstones, the stacked array comprising:

a plurality of stackable containers, each container comprising:

an optically clear adhesive lid having a first optical property, the lid having an underside coating of a clear gel composition having a second optical property, the underside coating releasably holding the plurality of gemstones adhered thereto in fixed position during transportation of the stackable container; and a base sized to register with the lid, and configured to clamp releasably to the lid with a frictional clamping force, without hinges and without a snap fit closure, the base further sized to provide a gemstone containment volume sized and configured to contain the plurality of individual gemstones between an underside of the lid and the base, the containment volume having a depth such that when the plurality of individual gemstones is contained within the containment volume, a gemstone of the plurality of individual gemstones does not touch an upper surface of the base, and the plurality of individual gemstones is viewable in 360 degrees;

wherein the first and second optical properties are selected such that when the plurality of individual gemstones is contained in each of the stacked containers of the array, the lid allows each individual gemstone to be evaluated by a naked eye, or with a loupe, through the lid of the container;

wherein the frictional clamping force maintains the stackable container closed, and when the stackable container is opened in normal use, the frictional clamping force is overcome without dislodging of a contained gemstone from the underside coating; and wherein an upper region of the lid is adapted to friction-mount releasably to an underside of a base of a first adjacent container; and a lower region of the base is adapted to friction-mount releasably to an upper region of a lid of a second adjacent stackable container such that the containers are releasably stacked by frictional clamping force in an array and are separable from each other without causing the plurality of individual gemstones in the stackable containers to separate from the underside coating.

8. The stacked array of containers of claim 7, wherein a top side of the base comprises an upward projecting wall spaced from the sides of the base and extending around a perimeter of the base, the wall sized and configured to register with the lid and to clamp to the lid with frictional force.

9. The stacked array of containers of claim 8, wherein a pry slot is formed on a side of the base, the pry slot extending in depth from the side of the base up to the upwardly projecting wall such that, when the stackable container is closed, the pry slot facilitates gripping the lid for separation of the lid from the base.

10. The stacked array of containers of claim 7, wherein the upper region of the lid is stepped inward and sized to register with and friction-mount releasably to an underside recessed region of a base of a second stackable container; and wherein the underside of the base has a surrounding wall around the perimeter of the base, the surrounding wall enclosing the recessed region that is sized to receive the upper stepped region of a lid of a third stackable container such that the container is stackable in an array with the second and third containers.

11. The stacked array of containers of claim 7, wherein the lid comprises a slot in an upper surface thereof, the slot spaced from a side of the lid; and sized to register with and receive therein a projecting tab from an underside of a base of a like second stackable container in a friction-mount; and wherein the underside of the base has a projecting tab spaced from a perimeter of the base, the projecting tab sized for friction fit to a slot in a lid of a like third stackable container such that a plurality of stackable containers are stackable in an array.

12. The stacked array of containers of claim 7, wherein each stackable container is sized and configured such that a side-by-side array of stackable containers fits snugly within dimensions of a jeweler's tray.

13. A stackable container sized and configured for containing a plurality of individual gemstones, the stackable container comprising:

an optically clear lid having a first optical property, the lid having an underside coating of a clear gel adhesive composition having a second optical property, the underside coating releasably holding each of the plurality of individual gemstones in contact with the underside coating in fixed position during transportation of the container; and a base sized to register with the lid, and configured to clamp releasably to the lid with a frictional clamping force, without hinges and without a snap fit closure, the base further sized to provide a gemstone containment volume between an underside of the lid and the base, the containment volume having a depth such that when the plurality of individual gemstones is contained within the containment volume and is attached to the underside coating, the plurality of individual gemstones does not touch an upper surface of the base, and each of the plurality of individual gemstones is viewable in 360 degrees, the base comprising an upward projecting wall spaced from sides of the base and extending around a perimeter of the base, the wall sized and configured to register with the lid and to clamp to the lid with frictional force;

a pry slot formed on a side of the base, the pry slot extending in depth from the side of the base up to the upward projecting wall such that when the stackable container is closed, the pry slot facilitates separation of the lid from the base wherein the first and second optical properties are selected to allow each of the plurality of individual gemstones, when contained in the stackable container, to be evaluated by a naked eye, or with a loupe, through the lid of the container;

wherein the frictional clamping force maintains the container closed, and when the container is opened in normal use, the frictional clamping force is overcome without dislodging of a contained gemstone from the underside coating; and wherein an upper region of the lid is stepped inward and sized to register with and friction-mount releasably to a recessed region in an underside of a base of a second stackable container; and wherein the underside of the base has a surrounding wall around the recessed region of the base, the recessed region sized to receive the upper stepped region of a lid of a third stackable container such that a plurality of stackable containers are stackable in an array.

14. The stackable container of claim 13, wherein the stackable container is sized and configured such that a side-by-side array of stackable containers fits snugly within dimensions of a jeweler's tray.

* * * * *